US005965022A

United States Patent [19]

Gould et al.

[11] Patent Number: 5,965,022

[45] Date of Patent: Oct. 12, 1999

[54] CYCLONE SEPARATOR ASSEMBLY

[75] Inventors: Peter Gould, Ledbury; Martin Dennis Grewer, Evesham, both of United Kingdom

[73] Assignee: Kvaerner Process Systems A.S., Billingstad, Norway

[21] Appl. No.: 08/887,750

[22] Filed: Jul. 3, 1997

[30] Foreign Application Priority Data

Jul. 6, 1996 [GB] United Kingdom ..... 9614257

[51] Int. Cl.[6] ..... B04C 5/24

[52] U.S. Cl. ..... 210/512.2; 209/711; 209/728; 55/345; 55/502

[58] Field of Search ..... 210/512.1, 512.2, 210/788; 55/345, 459.1, 502; 209/711, 728

[56] References Cited

U.S. PATENT DOCUMENTS 2,765,918 10/1956 Fontein et al. ..... 210/512.2

4,650,584 3/1987 Macierewicz .

FOREIGN PATENT DOCUMENTS 56-081149 7/1981 Japan .
2 136 327 9/1984 United Kingdom .
2 258 174 2/1993 United Kingdom .
85/00759 2/1985 WIPO .

*Primary Examiner*—David A. Reifsnyder
*Attorney, Agent, or Firm*—Andrus, Sceales, Starke & Sawall

[57] ABSTRACT

A cyclone separator assembly comprising a pressure vessel divided internally by first and second generally parallel dividing plates to define an overflow chamber, an underflow chamber, and an inlet chamber intermediate the overflow and underflow chambers, the dividing plates having aligned bores therein for receiving and supporting respective end regions of respective cyclone separator tubes, the ends of the bores in the first dividing plate opening into the overflow chamber being partially obstructed by restraining means restricting displacement of the cyclone tubes in a direction towards the overflow chamber.

12 Claims, 3 Drawing Sheets

18
12
22
41
20
3
40
36
4
38
39
30
32
16
14
10
6
2
8
26
34
24
28
60
64
62

CYCLONE SEPARATOR ASSEMBLY

This invention relates to a cyclone separator assembly comprising a plurality of cyclone separators housed in an array in a common pressure vessel.

Fluids of different densities, for example oil and water, can be separated using a cyclone separator, and where large volumes of mixture are to be processed a plurality of cyclone separators may be operated in parallel within a common pressure vessel. The term "fluid" as used herein denotes liquids, gases, particulate solids, and suspensions of such particulate solids in liquid or gaseous media. Hereinafter, for convenience, the invention will be described in relation to separation of oil and water mixtures and accordingly the cyclone separator will be referred to as a hydrocyclone.

GB-B-2258174 discloses a cyclone separator assembly comprising a plurality of hydrocyclones housed in a common pressure vessel. The pressure vessel is divided internally by first and second parallel walls to produce an oil outlet chamber, a water outlet chamber and an intermediate mixture inlet chamber. The elongate tubes defining the hydrocyclones are supported parallel with one another by the first and second dividing walls, the tubes passing through apertures in the dividing walls. Within the oil outlet chamber each hydrocyclone includes an overflow adapter having a flange abutting the dividing wall and an end surface abutting the closure member of the pressure vessel. Each overflow adapter can transmit load from the dividing wall to the closure member and each has radial drillings whereby oil overflow can enter the oil outlet chamber. Such an arrangement is disadvantageous in that it relies upon the overflow adapter to transmit load from the cyclone, and from the dividing wall to the closure member of the pressure Vessel and in that the necessary provision of a radial flange limits the packaging density of hydrocyclones within the pressure vessel. Furthermore, upon removal of the closure member of the pressure vessel the overflow adapters of the hydrocyclones are exposed within the oil outlet chamber and are thus susceptible to damage.

GB-A-2136327 illustrates an alternative arrangement in which the hydrocyclone tubes are axially trapped between the dividing plates therebeing sealing rings at the axial ends of the tubes compressed between surfaces extending generally at right angles to the tube axes. Such an arrangement requires the assembly to be loaded in an axial direction to ensure that the seals are effective, and thus cannot readily accommodate thermal expansion and contraction of the hydrocyclone tubes.

It is an object of the present invention to provide a cyclone separator assembly wherein the aforementioned disadvantages are minimised, or obviated, in a simple and convenient manner.

In accordance with the present invention there is provided a cyclone separator assembly comprising a pressure vessel divided internally by a dividing plate to define first and second chambers, a plurality of cyclone separator tubes extending with the second chamber, each tube having its overflow end region received in a respective through bore in the dividing plate so as to communicate with the first chamber, and, restraining means at the first chamber end of each of the bores partially obstructing the through bores to restrict longitudinal displacement of the respective cyclone tube towards the first chamber.

Preferably, the restraining means includes a plate having an aperture therein overlying the end of the through bore in the dividing plate, the aperture being of smaller diameter than the through bore.

Preferably the restraining means includes an apertured plate common to a plurality of the through bores.

Alternatively the restraining means includes an elongate element extending across the end of the through bore in the dividing plate.

Desirably, the elongate element is common to the plurality of through bores in the dividing plate.

Conveniently a plurality of elongate elements are interconnected to define a unitary restraining means associated with the plurality of through bores in the dividing plate.

Preferably, the restraining means is trapped between the dividing plate and a wall of the pressure vessel whereby a load imposed on the restraining means is transferred to the wall of the pressure vessel.

Desirably, where a restraining means comprises an apertured plate, elongate elements extend between the plate and the wall of the vessel to transfer the load to the wall.

Preferably, the end region of each cyclone tube received within a respective bore in the dividing plate is encircled by a ring seal sealing the cylindrical interface of the tube and each respective bore.

Desirably the cyclone separator assembly comprises a pressure vessel divided internally by first and second generally parallel dividing plates to define an overflow chamber, an underflow chamber, and an inlet chamber intermediate the overflow and underflow chambers, the dividing plates having aligned bores therein for receiving and supporting respective end regions of respective cyclone separator tubes, the ends of the bores in the first dividing plate opening into the overflow chamber being partially obstructed by restraining means restricting displacement of the cyclone separator tubes in a direction towards the overflow chamber, Conveniently, the restraining means comprises an apertured plate housed in the overflow chamber and having its apertures aligned with the through bores of the first dividing plate, the apertures being of smaller diameter than the bores.

Alternatively the restraining means comprises a plurality of bars, each bar extending across the end of at least one of the bores in the first dividing plate.

One example of the invention as illustrated in the accompanying drawings wherein.

As mentioned above the following examples will be described in the context of oil and water separation. However it is not intended that the invention be limited to separation of mixtures of these two liquids, and it will be understood that the invention extends to the separation of mixtures of fluids of different densities, the term "fluid" including particulate solids and suspensions of particulate solids in a gaseous or liquid media.

Figures 1, 2:
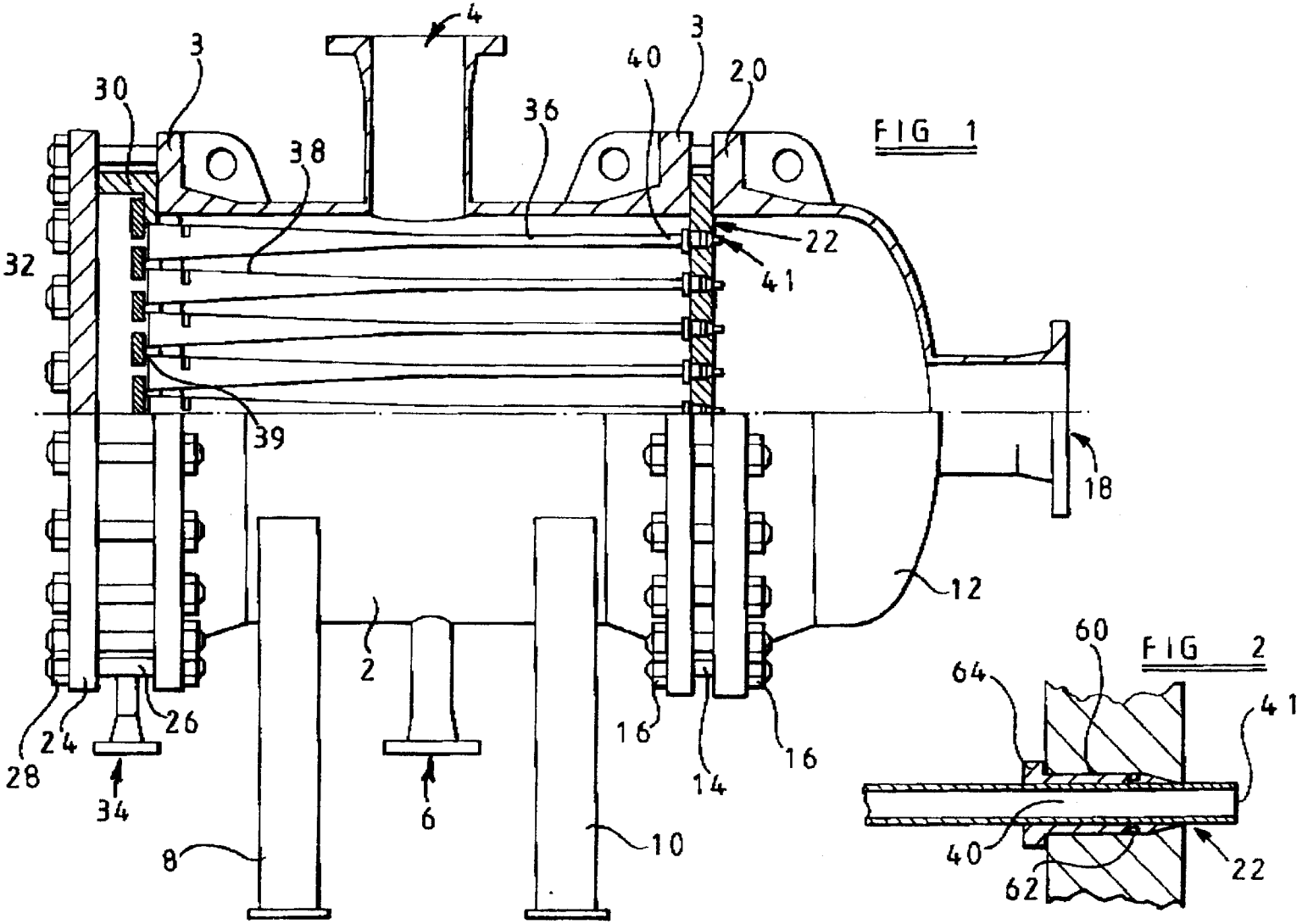
FIG. 1 is a diagrammatic cross-sectional view of cyclone separator assembly.
FIGS. 2 and 3 are enlarged cross-sectional views of parts of the assembly of FIG. 1 illustrating in particular the mounting of the cyclone separator tubes.
Figure 3:
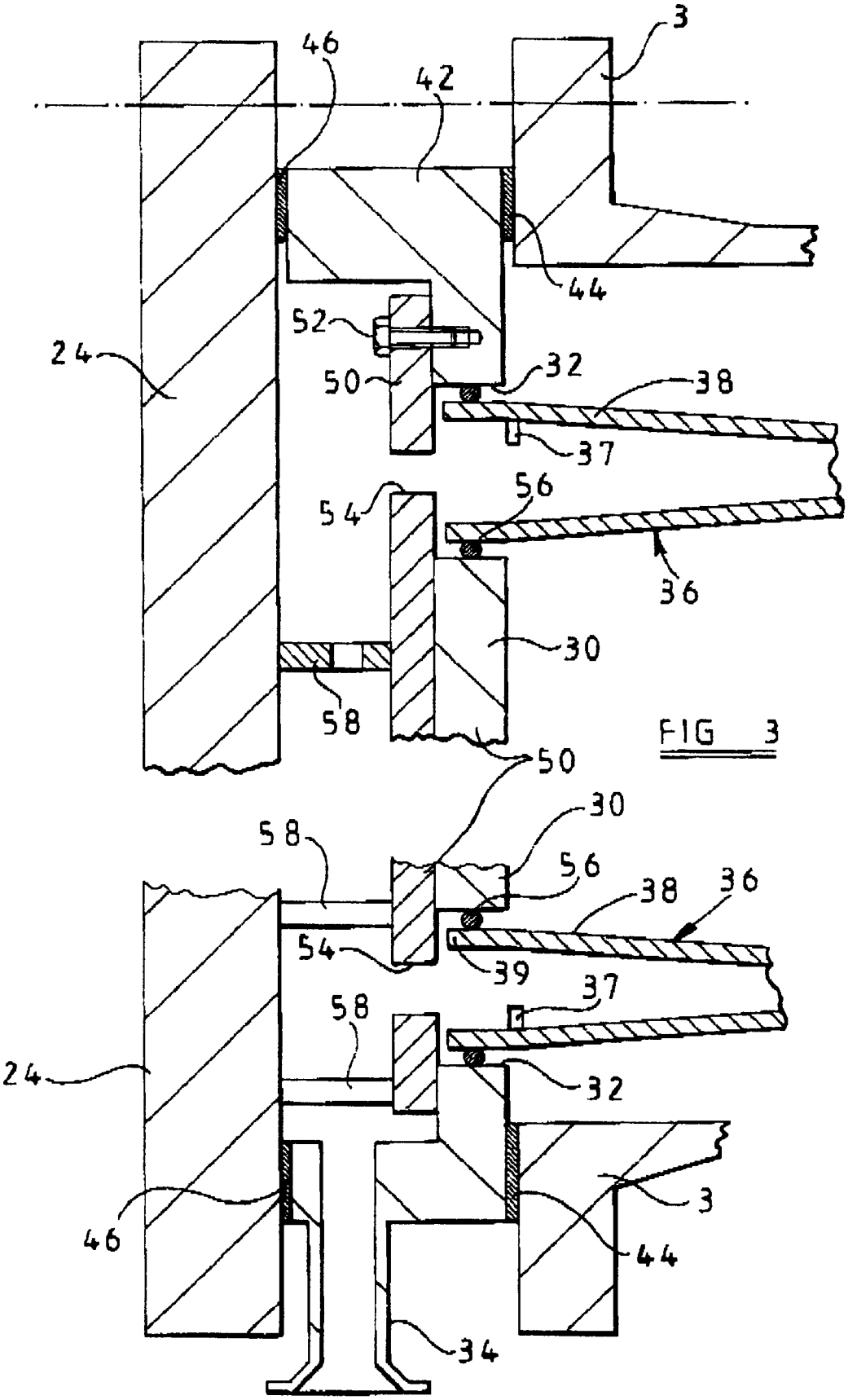

Referring first to FIGS. 1 to 3, the hydroclone assembly comprises a pressure vessel housing an array of hydrocyclone tubes. The pressure vessel includes a hollow, circular cylindrical body 2 having peripheral flanges 3 at its opposite axial ends respectively. An inlet passage 4 communicates with the interior of the body 2 through the wall thereof, and similarly a vent passage 6 communicates with the interior of the body 2. The body 2 is mounted on a pair of vertical support members 8,10. A removable end cap 24, formed as a blind flange, is attached to one axial end of the body 2 by means of threaded rods 26 extending through the end cap and the flange 3 of the body 2, the threaded rods 26 carrying nuts 28. A dividing plate 30 having a plurality of through bores 32 is trapped between the flange 3 of the body 2 and the end cap 24 and an overflow chamber defined between the plate 30 and the end cap 24 has an outlet passage 34 communicating therewith.

At its opposite axial end the body 2 is closed by a water chamber housing 12 having a flange secured to the flange 3 at the opposite axial end of the body 2 by means of threaded rods 14 and nuts 16. A second dividing plate 20 is trapped between the body 2 and the housing 12 and is formed with a plurality of circular bores 22 aligned respectively with the through bores 32 of the dividing plate 30. An underflow outlet chamber is defined between the housing 12 and the plate 20 and the housing 12 is formed with an outlet 18. In a modification the housing 12 and plate 20 are welded to the body 2 and the flange 3 is omitted A plurality of elongate tapering tubes defining hydrocyclone separators 36 are located within the body 2 by engagement of opposite end regions respectively in respective bores of the plates 20, 30. Each of the hydrocyclones 36 comprises one or more inlet ducts 37, a first end portion 38 having an end 39, and a second, opposite end portion 40 terminating at an end 41. The end portions 38 are disposed in respective bores 32 of the plate 30 while the corresponding end portions 40 are disposed in corresponding bores 22 of the plate 20. As will be explained in more detail hereinafter the end regions of the tubes are sealed in their respective bores, and thus the pressure vessel can be considered to be divided internally by the plates 20, 30 to define in a central, inlet chamber having an inlet 4 and disposed between an overflow chamber and an underflow chamber. The overflow chamber, which receives oil in the example, is defined between the plate 30 and the end cap 24 and has an oil outlet 34. The underflow chamber, which receives water in the example, is defined between the plate 20 and the housing 12 and has a water outlet 18.

With particular reference to FIG. 2 it can be seen that at the narrow, underflow end of each hydrocyclone the end portion 40 carries a steel sleeve 60 having a shoulder 64 which can abut the inlet chamber face of the dividing plate 20. An elastomeric O-ring seal 62 is carried by the sleeve 60 intermediate its ends, and thus engages the cylindrical wall of the respective bore 22 within which the sleeve 60 is received.

The opposite end region 38 of each hydrocyclone 36 is received within a corresponding bore 32 of the dividing plate 30 such that the hydrocyclones are aligned axially of the pressure vessel in a predetermined spaced array.

As is apparent from FIG. 3, the end 39 of each hydrocyclone end portion 38 terminates within the respective bore 32 and the end portion carries an elastomeric O-ring seal 56 which engages the cylindrical surface of the respective bore 32 to seal the interface between the through bore 32 and the hydrocyclone 36. The inlet(s) 37 of the hydrocyclones are of course exposed within the inlet chamber.

The dividing plate 30 is formed with a peripheral spacing portion 42 which spaces the end cap 24 from the plate 30 to define the overflow chamber. A first annular seal 44 is disposed between the flange 3 of the body 2 and the periphery of the plate 30, and a second annular seal 46 is disposed between the face of the peripheral spacing portion 42 and the end cap 24. The oil outlet 34 communicates with the oil overflow chamber by way of a bore 48 in the spacing portion 42.

It is of course apparent from the mounting arrangement of the hydrocyclones 36 that there is a freedom of axial movement of the hydrocyclones 36 relative to the plates 20, 30 for example to accommodate thermal expansion. The freedom of axial movement is restricted in one direction by abutment of the shoulder 64 of each respective sleeve 60 with the plate 20, and a restraining plate 50 is provided within the overflow chamber to restrict movement of the hydrocyclones 36 in the opposite axial direction. The hydrocyclone restraining plate 50 comprises a circular steel plate received within the confines of the spacing portion 42 of the plate 30, and thus lying within the overflow chamber. The plate 50 has a plurality of bores 54 which, when the plate 50 is located in the desired position relative to the plate 30, are coaxial with the through bores 32 of the plate 30. The means of locating the plate 50 relative to the plate 30 is not of relevance to the invention, and it will be recognized that where the assembly is to be used with the plane of the plate 50 other than horizontal then it may be desirable to use bolts 52 extending through the plate 50 and into the plate 30 to lock the plate 50 In position.

The diameter of the through bores 54 in the plate 50 is smaller than the diameter of the through bores 32 in the plate 30 and thus portions of the plate 50 overlie the ends of the through bores 32 and provide an abutment for the ends 39 of the hydrocyclones 36.

A plurality of steel rods 58 extend across the oil overflow chamber from the plate 50 to the end cap 24, being welded to the plate 50 and/or the end cap 24. The rods 58 transmit load from the plate 50 to the end cap 24 such load being generated by the pressure imposed upon the plate 30 and any axial loading imposed on the plate 50 by the tubes 36. As an alternative a plurality of bars, disposed transverse to the restraining plates 50 could be used to transmit the load, and as a further alternative one or more pipes disposed axially in relation to the pressure vessel could be utilized. The design of the end cap 24 of the pressure vessel is such that it is able to accommodate in excess of the maximum internal loading which will be imposed on the vessel even in a fault condition, and thus it is desirable to transmit loads back to the end cap 24 in use.

In operation of the assembly a mixture of oil and water is introduced under pressure into the inlet chamber by way of the inlet 4. The mixture enters the plurality of hydrocyclones 36 simultaneously through their respective inlet ducts 37 and, in known manner, is separated by the centrifugal action within the hydrocyclones so that relatively oil free water flows from the underflow end 41 of each hydrocyclone into the water outlet chamber, while substantially water free oil leaves the hydrocyclones through their ends 39, passing through the through bores 54 of the plate 50 into the oil overflow chamber.

Figure 4:
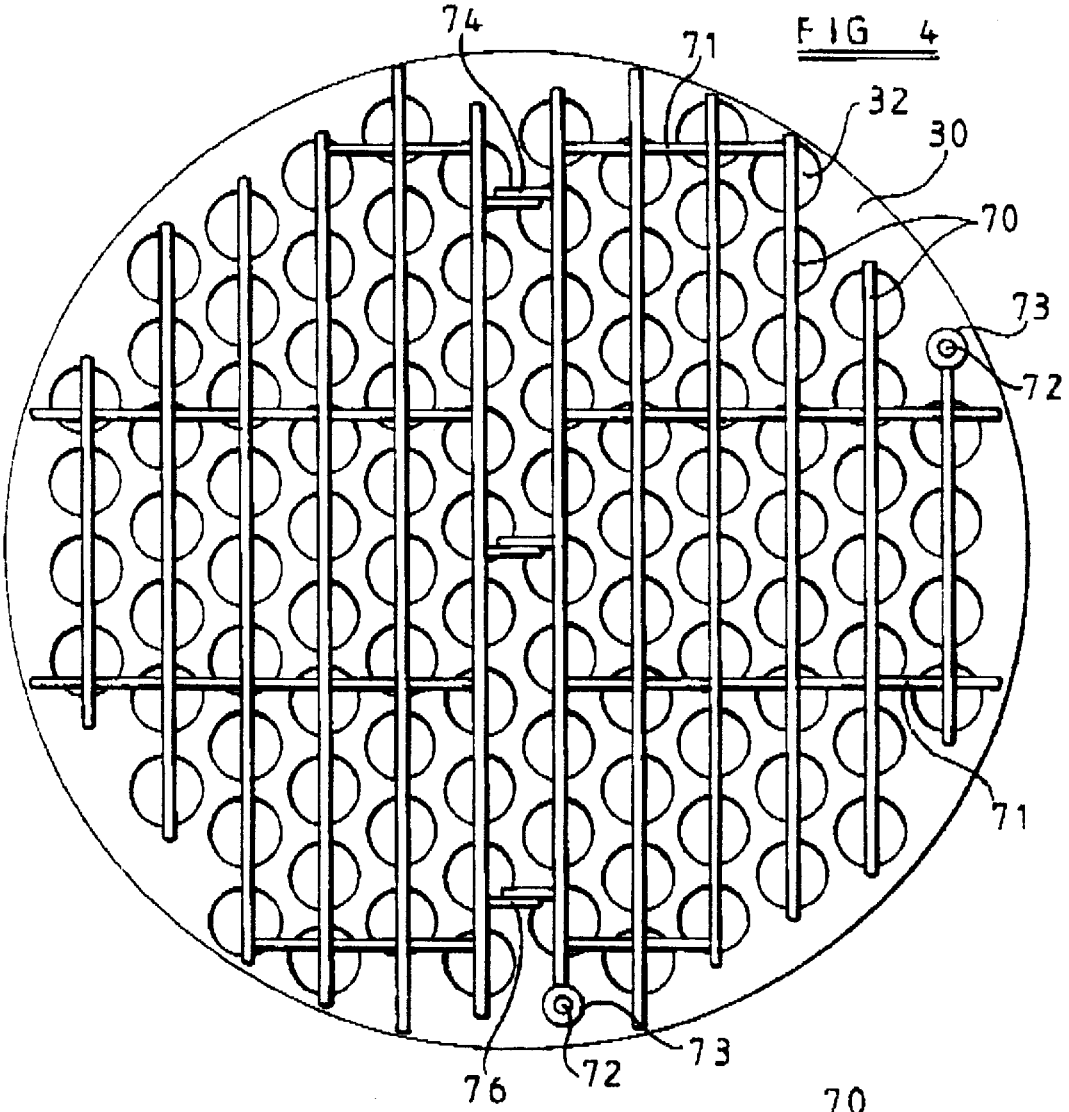
FIG. 4 is a plan view of an alternative tube restraining arrangement to that illustrated in FIGS. 1 to 3.
Figure 5:
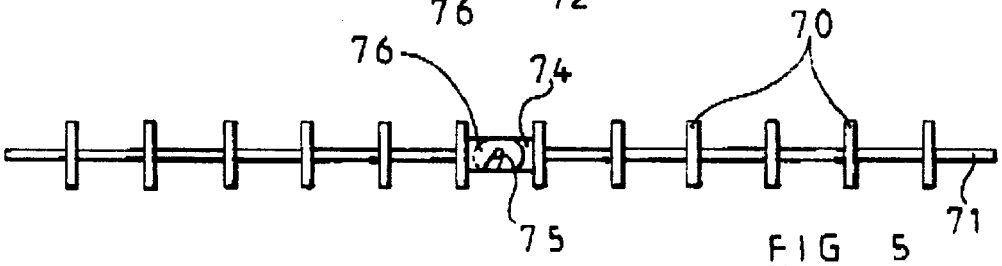
FIG. 5 is a side elevational view of the restraining element of FIG. 4.
Figure 6:
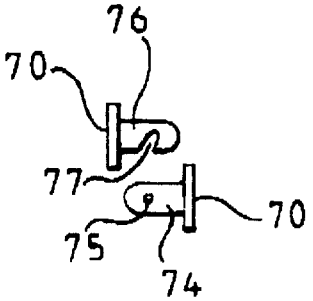
FIG. 6 is a scrap view illustrating interconnection of two parts of the element of FIG. 3.

FIGS. 4, 5 and 6 illustrate an alternative construction for restraining the hydrocyclones 36 at their overflow ends. The plate 50 is dispensed with, and in its place there is provided a plurality of lengths of stainless steel bar of rectangular cross-section. The bars 70 are aligned parallel to one another with a longitudinally extending edge thereof engaging the plate 30, and are dimensioned to extend across the plate 30 within the oil overflow chamber. The width of the material of each bar 70 is equal to the spacing between the plate 30 and the end cap 24 so that the bars are trapped between the plate 30 and the end cap 24 in use, and thus can transmit load from the plate 30 to the end cap 24. The thickness of the material of the bars 70 is substantially less than the diameter of the through bores 32, and the bars 70 are arranged to extend substantially diametrically across a respective aligned plurality of bores 32. Thus each bore 32 in the plate 30 has its overflow end partially obstructed by a respective bar 70 which thus acts as a restraining member limiting axial movement of the respective hydrocyclone 36.

The bars 70 are secured in position relative to one another by a plurality of transversely extending stainless steel rods 71 of circular cross-section which are welded or otherwise secured to the bars 70. The rods 71 thus define, with the bars, a form of grid. A pair of location dowels 72 project from the face of the plate 30 into the oil overflow chamber, and the assembly of bars 70 and rods 71 is provided with a pair of eyelets 73 which locate on the dowels 72 to position the grid in relation to the plate 30 In addition, selected bars 70 and rods 71 can be dimensioned such that their opposite axial ends engage the wall of the spacer portion 42 of the plate 30 to assist location of the grid within the overflow chamber.

Where the body diameter is small the grid may be of unitary construction, but larger grids may be inconvenient to handle manually and so the grid can be formed in two or more interlocking parts in order to facilitate handling in use. The grid in FIGS. 4 and 5 is formed in two generally symmetrical diametric halves one of which has protruding lugs 74 carrying transverse pivot posts 75 and the other of which has corresponding lugs 76 formed with inclined slots 77 for receiving the posts 75. In use therefore one diametric half can be hinged relative to the other half about the posts 77 before being lifted to disengage the slots 77 from the posts 75, to permit the grid to be handled in two separate halves.

We claim:

1. A cyclone separator assembly comprising a pressure vessel divided internally by a dividing plate to define first and second chambers, a plurality of cyclone separator tubes extending within said second chamber, each tube having an overflow end region movable received for longitudinal displacement within a respective bore in said dividing plate so as to communicate with said first chamber, and restraining means at the first chamber end of each of said bores partially obstructing said bores to restrict longitudinal displacement of the respective cyclone separator tube towards said first chamber.

2. A cyclone separator assembly comprising a pressure vessel divided internally by a dividing plate to define first and second chambers, a plurality of cyclone separator tubes extending within said second chamber, each tube having its overflow end region received for longitudinal displacement within a respective bore in said dividing plate so as to communicate with said first chamber and restraining means at the first chamber end of each of said bores partially obstructing said bores to restrict longitudinal displacement of the respective cyclone separator tube towards said first chamber, wherein said restraining means includes a plate having an aperture therein overlying the end of said respective bore in said dividing plate, said aperture being of smaller diameter than said bore.

3. An assembly as claimed in claim 2 wherein said plate has a plurality of apertures therein and is restraining means common to a said bores of said dividing plate.

4. An assembly as claimed in claim 2 wherein said restraining means includes an elongate element extending across an end of one of said bores in said dividing plate.

5. An assembly as claimed in claim 4 wherein said elongate element is common to each of said bores in said dividing plate.

6. An assembly as claimed in claim 2 wherein a plurality of elongate elements are interconnected to define said restraining means.

7. An assembly as claimed in claim 2 wherein said restraining means is trapped between said dividing plate and a wall of said pressure vessel whereby a load imposed on said restraining means is transferred to said wall of said pressure vessel.

8. An assembly as claimed in claim 7 wherein said restraining means is an apertured plate and a plurality of elongate elements extend between the apertured plate and said wall of said pressure vessel to transfer said load to said wall.

9. An assembly as claimed in claim 2 wherein said overflow end region of each of said cyclone separator tubes received within the respective bore in said dividing plate is encircled by a ring seal sealing a surface between said tube and a wall of the respective bore.

10. A cyclone separator assembly comprising a pressure vessel divided internally by first and second generally parallel dividing plates to define an overflow chamber, an underflow chamber, and an inlet chamber intermediate said overflow and underflow chambers, said dividing plates having aligned bores therein for movably receiving and supporting for longitudinal movement therein respective end regions of respective cyclone separator tubes, said bores in said first dividing plate opening into said overflow chamber being partially obstructed by restraining means restricting displacement of said cyclone separator tubes in a direction towards said overflow chamber.

11. A cyclone separator assembly comprising a pressure vessel divided internally by first and second generally parallel dividing plates to define an overflow chamber, an underflow chamber, and an inlet chamber intermediate said overflow and underflow chambers, said dividing plates having aligned bores therein for receiving and supporting respective end regions of respective cyclone separator tubes, said bores in said first dividing plate opening into said overflow chamber being partially obstructed by restraining means restricting displacement of cyclone separator tubes in a direction towards said overflow chamber, wherein said restraining means comprises an apertured plate housed in said overflow chamber and having its apertures aligned with said bores of said first dividing plate, the apertures being of smaller diameter than said bores.

12. An assembly as claimed in claim 11 wherein said restraining means comprises a plurality of bars, each bar extending across the end of at least one of said in the first dividing plate.

* * * * *